US006269282B1

(12) United States Patent
Burger et al.

(10) Patent No.: US 6,269,282 B1
(45) Date of Patent: Jul. 31, 2001

(54) ELECTRONIC CONTROL APPARATUS FOR A TEXTILE MACHINE

(75) Inventors: Wilhelm Burger, Fuerth; Hans-Joachim Stuewe, Sachsen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/490,325

(22) Filed: Jan. 24, 2000

(30) Foreign Application Priority Data

Jul. 23, 1997 (DE) ..... 197 31 692
Oct. 31, 1997 (DE) ..... 197 48 293

(51) Int. Cl.[7] ..... D04B 15/78; D04B 27/32
(52) U.S. Cl. ..... 700/131; 700/141; 66/232
(58) Field of Search ..... 700/131, 130, 700/132, 133, 141; 66/231, 232, 237, 8, 13

(56) References Cited

U.S. PATENT DOCUMENTS 5,956,978 * 9/1999 Dorn et al. ..... 700/141
6,182,477 * 2/2001 Shibata ..... 700/141 X

FOREIGN PATENT DOCUMENTS 2330420 10/1974 (DE) .
4017482 A1 1/1991 (DE) .
4442555A1 6/1996 (DE) .

OTHER PUBLICATIONS

Patent Abstracts of Japan, V96, N12, Aug. 27, 1996 (JP 82 18 255).

* cited by examiner

*Primary Examiner*—Peter Nerbun
(74) *Attorney, Agent, or Firm*—Sughrue, Mion, Zinn, Macpeak & Seas, PLLC

(57) ABSTRACT

An electronic control apparatus according to an embodiment of the invention includes serial-parallel converters, a serial data bus, an electronic processing unit, and assignment mechanisms. Each of the serial-parallel converters is connected to at least one group of mechanical actuation elements of a textile machine. Further, the plurality of serial-parallel converters is connected sequentially to the serial data bus. The electronic processing unit forms pattern data blocks from textile pattern data and transmits the pattern data blocks to the serial-parallel converters. The pattern data blocks are output in transmission cycles, by the assignment mechanisms, to mechanical actuation elements in the groups of mechanical actuation elements.

11 Claims, 5 Drawing Sheets

ELECTRONIC CONTROL APPARATUS FOR A TEXTILE MACHINE

This is a Continuation of International Application PCT/DE98/01998, with an international filing date of Jul. 16, 1998, the disclosure of which is incorporated into this application by reference.

FIELD OF AND BACKGROUND OF THE INVENTION

The invention relates to an electrical control apparatus for the output of textile pattern data to groups of mechanical actuation elements that actuate needles for guiding thread in a textile machine.

A warp knitting machine with at least one laying bar and a control apparatus is known from the document DE 44 42 555 C2. The control apparatus therein has a main computer to which subordinate computers are attached in star formation via a serial bus. A subordinate computer is assigned to each member of a set of flexible converters disposed on the laying bar to drive that flexible converter. A serial-parallel converter is furthermore assigned to each flexible converter for addressing and data transmission. Each subordinate computer prepares data so that the flexible converter attached thereto is addressed individually and is subsequently provided with the control data.

It is disadvantageous to require a subordinate computer for each laying bar because of the high processing speed that is necessary. However, in the case of a large number of laying bars, as in the case of large textile machines, a correspondingly high number of subordinate computers is disadvantageously needed. The sequential addressing of the individual flexible converters requires the subordinate computers and electronic components to have a high processing speed because the flexible converters must be controlled rapidly and synchronously. Thus, an expansion of the number of laying bars also disadvantageously requires additional high-speed subordinate computers.

A control apparatus for piezoelectric actuators for a knitting machine is known from the document JP 82 18 255. The piezoelectric actuators each have a driver circuit which is connected to a control unit via a parallel bus. In this case the control unit selects a definite driver circuit of a piezoelectric actuator in a first step by the output of a parallel address signal and then transmits the pattern data to it in a second step.

It is disadvantageous that each piezoelectric actuator must first be activated for addressed data transmission via an additional address signal before it can receive the actual pattern information. Due to the relatively long data transmission times a controller of this type is not applicable without high technological expenditure for rapidly running textile machines or larger textile machines that require a large number of piezoelectric actuators.

An electronically controlled Jacquard machine, for controlling the warp thread of a weaving loom, is known from the document DE-OS 2 330 420. Therein, a serial-parallel converter is formed as a shift register, and is connected between an information transmitter and the flexible vibrators. It is disadvantageous that the shift register for each of the flexible vibrators has a register unit and all the flexible vibrators are driven simultaneously by the information transmitter per transmission cycle. Because of the foregoing, the number of transmissions per unit time, and thus the maximal operating speed of the Jacquard machine, is limited.

SUMMARY OF THE INVENTION

It is an object of the invention to achieve a faster electrical control apparatus.

Further, it is an object of the invention to achieve a faster electrical control apparatus which allows easy control of the textile machine even when any number of laying bars are added or removed from the textile machine.

It is a further object of the invention to achieve a faster electrical control apparatus which reduces data transmission time and which also reduces the technological expenditure for rapidly running textile machines and large textile machines that require a large number of actuators.

These and other objects are achieved by the embodiments of the present invention. According to one formulation of the invention, there is provided an electrical control apparatus, for a textile machine, which outputs textile pattern data to a plurality of groups of mechanical actuation elements for actuating thread guiding elements. This electrical control apparatus includes a plurality of serial-parallel converters each of which is connected to at least one of the groups of mechanical actuation elements. Each serial-parallel converter is configured to accept, for each connected group of mechanical actuation elements, at least one pattern data block form the textile pattern data. This electrical control apparatus further includes a serial data bus to which the serial-parallel converters are sequentially connected. An electronic processing unit, having a first connection to the data bus, in transmission cycles forms—from the textile pattern data—pattern data chains containing pattern data blocks for driving the mechanical actuation elements. Further, the electronic processing unit—in transmission cycles—inserts the pattern data chains into the serial data bus so that at the end of each transmission cycle at least one pattern data block is contained in each serial-parallel converter. Then, at the end of each transmission cycle, the electronic processing unit outputs a central release signal to a plurality of assignment devices. The assignment devices are connected to the serial-parallel converters, and to the groups of mechanical actuation elements. Upon receiving the central release signal, the assignment devices synchronously cause the serial-parallel converters to output the pattern data block currently contained in each serial-parallel converter to an actuation element in the group of mechanical actuation elements connected to that serial-parallel converter.

It is an advantage that an electronic control apparatus according to the present invention includes a single central, electronic processing unit that drives the mechanical actuation elements via a serial data bus. Thus, the number of actuation elements on the serial bus is arbitrarily set, and that number is easily expandable. Inserting pattern data blocks within one transmission cycle into the sequentially connected serial-parallel converters, which are assigned to groups of actuation elements, effects fast data transmission. It is particularly advantageous that no additional addressing of the individual actuation elements or serial-parallel converters needs to be done but, rather, the control data at the end of one transmission cycle is automatically present in the correct serial-parallel converter.

Further, it is particularly advantageous that—in the case of data transmission per corresponding transmission cycle—the control unit only transmits those data which are necessary to drive the actuation elements that are actually to be driven. According to the invention, merely one single actuation element per group is driven by mechanical actuation elements with one pattern data block per transmission cycle. Thus, only the data information for a single actuation element per group is transmitted and, thereby, the data transmission expenditure is advantageously kept to a minimum whereas the data transmission rate is maximized.

Furthermore, it is advantageous that for each central release signal, an actuation element of the associated group is addressed. Thereby the actuation elements of one group are driven one after the other in a sequence which corresponds to the sequential arrangement of the actuation elements in the group. Preferably, in this case, one storage element is assigned to each actuation element, and that storage element buffers the driving of that actuation element in one transmission cycle. Thus, for each transmission cycle only one actuation element per group is driven, and the state of the actuation element caused thereby, for example "set" or "not set", remains buffered until the corresponding actuation element is driven anew in a later transmission cycle.

Assignment means, preferably a multiplexer and a counter connected to it, are advantageously provided for each group of actuation elements. The counter is timed via a central release signal, and thus serves to drive the assigned multiplexer whereby a definite actuation element of a group is selected. The counter causes, for example, sequential driving of the actuation elements within each group. Advantageously, the pattern data chains, for the individual shift registers, transmitted to the data bus include pattern data blocks and control data blocks with which the individual counters, for example, can be set or reset for the initialization of the textile machine. This also advantageously allows the cyclic correction of transmission errors which could otherwise lead to a desychronization of the counters.

Preferably, the serial data bus beginning at the central electronic control apparatus and routed to the serial-parallel converters, is re-routed back to the central electronic control apparatus. Thus, test data blocks for error detection can be transmitted by the serial-parallel converters back to the central electronic processing unit of the control apparatus. This allows, for example, detection of malfunctioning actuation elements.

Further advantageous embodiments of the invention are specified in the detailed description of the invention and in the dependent claims.

BRIEF DESCRIPTION OF THE DRAWINGS

The invention and further advantageous refinements thereof are explained in more detail below with the aid of diagrammatic, exemplary, embodiments as shown in the drawings, in which.

DETAILED DESCRIPTION OF THE PREFERRED EMBODIMENTS

Figure 1:
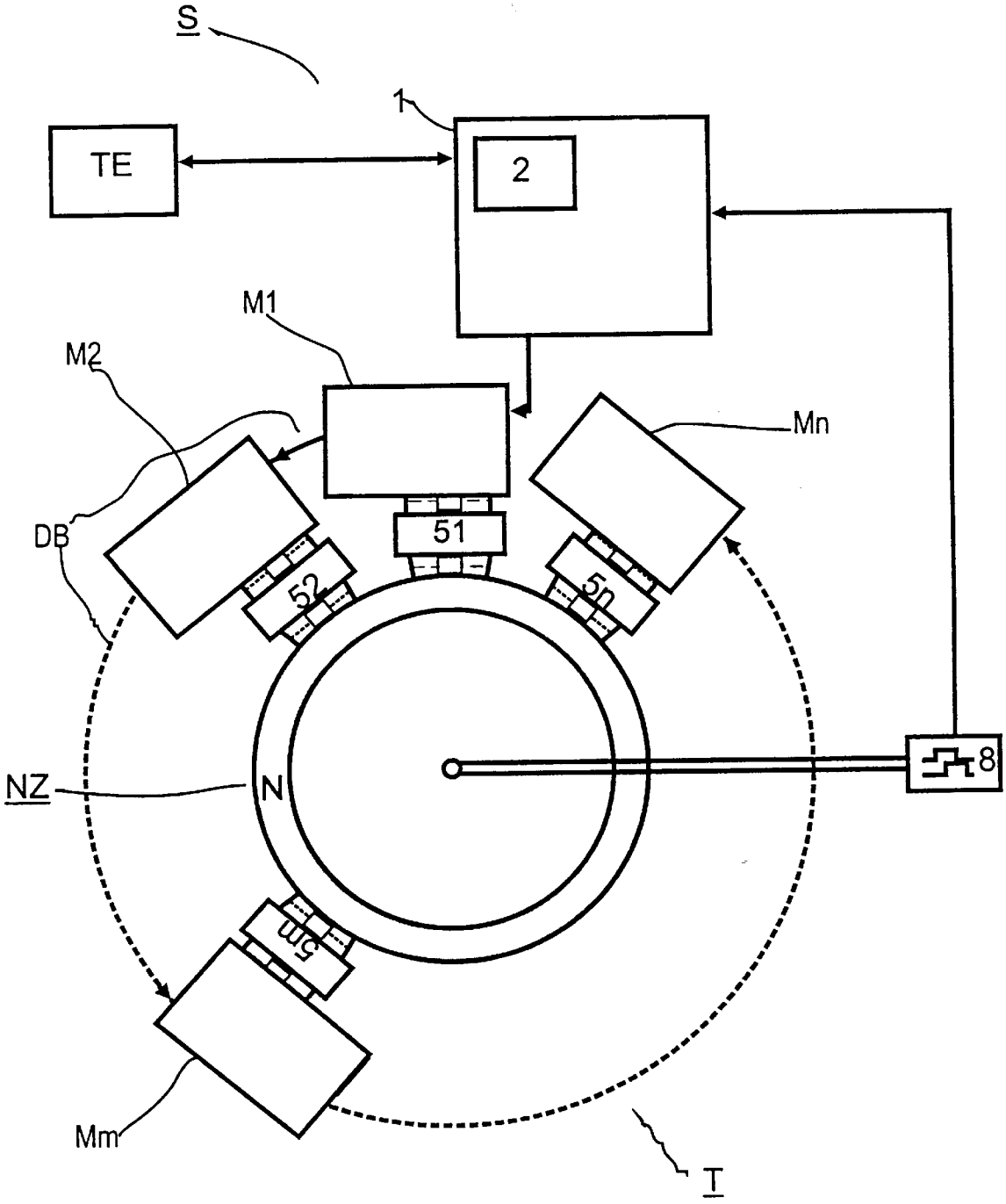
FIG. 1 shows a schematic design of a textile machine represented, for example, as a circular knitting machine with an electrical control apparatus according to the present invention and with control modules driven via a serial data bus.

FIG. 1 shows a textile machine T that is used for the pattern-controlled production of textiles. Textile machines T of this type of are, for example, knitting, meshing, or weaving machines. Also, such machines can be Jacquard machines which are used for the formation of textiles surfaces such as textile knits, meshes, or weaves.

Figure 2:
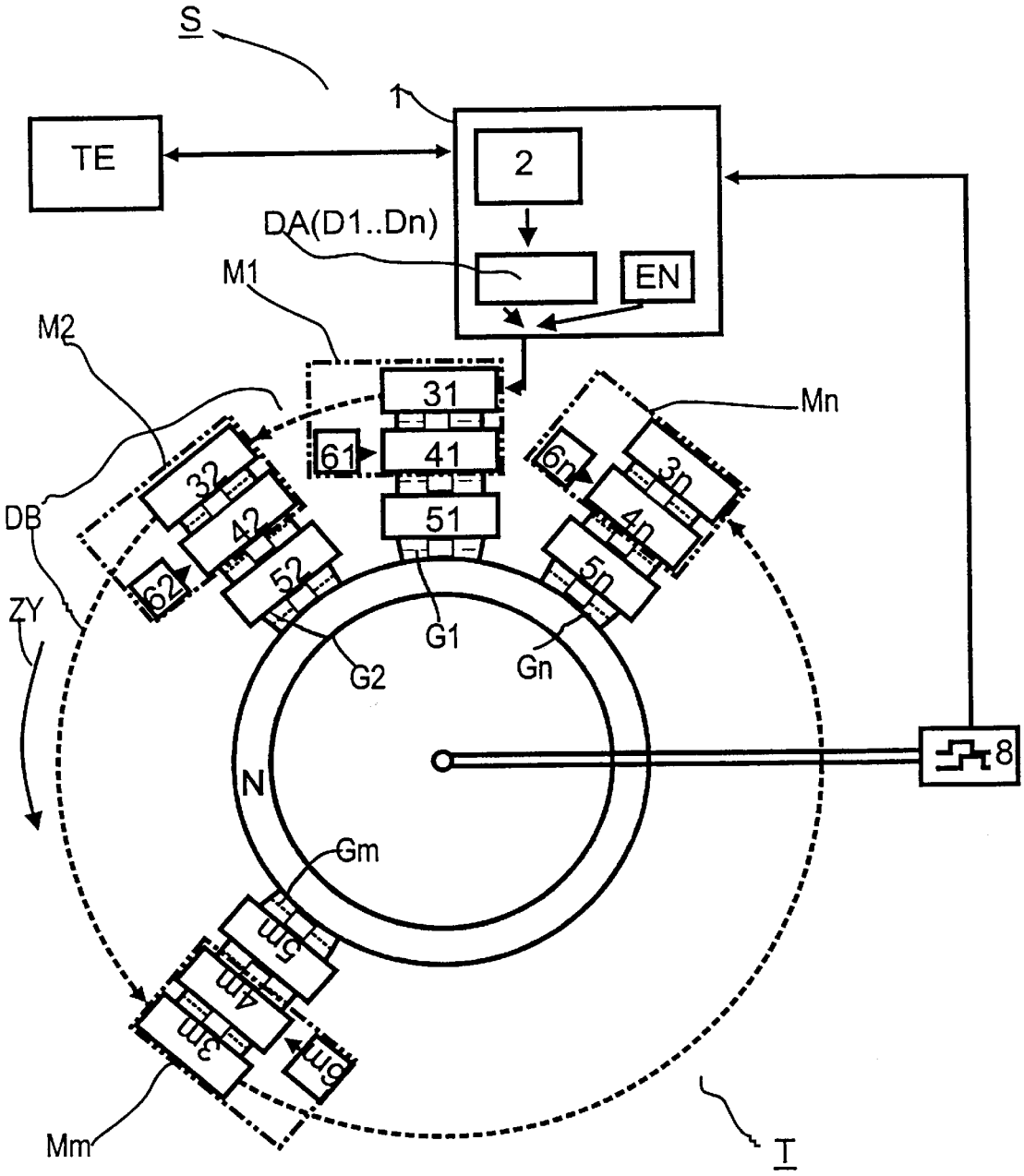
FIG. 2 shows the textile machine of FIG. 1, but with a more detailed representation of the control modules.

In FIGS. 1 and 2, the electrical control apparatus S according to the invention is described in connection with a textile machine T, which, for example, is a circular knitting machine. The control apparatus S has an electronic processing unit 1 in which, for example, textile pattern data 2 are stored. However, the textile pattern data 2 can also be supplied to the electronic processing unit 1 by an operator terminal TE or in other ways. The textile pattern data 2 include pattern data blocks D1 to Dn which are used by the control apparatus S for pattern-controlled driving of the control modules M1 to Mn which thereby processes, for example, threads, fibers, or the like, into textiles results.

FIGS. 1 and 2 show a textile machine T, represented as a circular knitting machine, for the pattern controlled production of textiles, having a rotatable needle cylinder NZ which has thread guidance means N, such as but not limited to, separately actuable needles. Threads for processing to textiles are supplied to the needles N. If the textile machine T is a weaving loom, for example, then, instead of needles as guiding means N, so-called harness threads which can be actuated by actuation elements are present for the formation of fabric. The thread guidance means N can be activated in a pattern-controlled way by actuation elements disposed in groups G1 to Gn. The actuation elements are driven by the electronic processing unit 1 of the control unit S according to the invention. The actuation elements are described later in connection with FIGS. 3*a* and 3*b*.

FIGS. 1 and 2, show a number n of generally fixed, decentralized, control modules that are represented by reference numbers M1, M2, . . . , Mm to Mn. According to the invention, the centrally disposed electronic processing unit 1 has groups of mechanical actuation elements that are represented by the reference numbers G1, G2, . . . , Gm to Gn. See FIG. 2, for example. The actuation elements are, for clarity, represented in FIG. 2 only in the form of the groups G1 to Gn. Generally, the groups G1 to Gn each have the same number of actuation elements. According to the invention, the control apparatus S serves to output textile pattern data 2 to the groups G1 to Gn of mechanical actuation elements for the thread guidance means N. The arrangement represented in FIG. 2, of one group G1 to Gn per control module M1 to Mn, represents merely a preferred form of embodiment of the invention since for each control module M1 to Mn an arbitrary number of groups of mechanical actuation elements can be provided.

According to the invention, the electronic processing unit 1 outputs a central release signal EN for the synchronized output of the textile pattern data 2 to the actuation elements at the end of a transmission cycle. In the example of FIGS. 1 and 2, the output signal of a clock generator 8 is used by the electronic control apparatus 1 for the generation of the release signal EN. The clock generator 8 may be, for example, an angular clock generator. In particular, the clock generator 8 is used by the electronic processing unit 1 for the calculation of the position of the movable thread guidance means N with respect to the fixed groups G1 to Gn of sequentially disposed actuation elements.

As is represented in FIG. 2, the electrical control apparatus S according to the invention has serial-parallel converters 31 to 3n. To each of the serial-parallel converters 31 to 3n, at least one group G1 to Gn of actuation elements is connected where, for each connected group G1 to Gn, at least one pattern data block D1 to Dn can be accepted from the textile pattern data 2. The groups G1 to Gn are preferably disposed in the actuation modules 51, 52, . . . , 5m to 5n, which are so-called piezoelectric flexible converters. Each of the flexible converter actuation modules 51, 52, . . . , 5m to 5n has one or more groups G1 to Gn of mechanical actuation elements, wherein the mechanical actuation elements in each group are disposed sequentially. The individual actuation elements are preferably present in the form of magnetic or piezoelectric actuators such as, for example, piezoelectric flexible converters.

Furthermore, the control apparatus S has a serial data bus DB to which the serial-parallel converters 31 to 3n are sequentially connected. The serial data bus DB transmits pattern data chains DA, formed from the textile pattern data 2, from the electrical processing unit 1 to the serial-parallel converters. The serial-parallel converters 31 to 3n are shift registers, and serve for the conversion of serial data transmitted on the data bus DB into parallel data. The serial-parallel converters 31 to 3n are referred to, in the following description, as shift registers 31 to 3n.

The electronic processing unit 1 forms, in transmission cycles ZY, pattern data chains DA containing pattern data blocks D1 to Dn in such a way that one pattern data chain DA per transmission cycle ZY contains pattern data blocks D1 to Dn for driving one actuation element in each group G1 to Gn. Furthermore, during transmission cycles ZY, the electronic processing unit 1 inserts pattern data chains DA into the serial data bus DB so that at the end of the transmission cycle ZY, at least one pattern data block D1 to Dn from the pattern data chain DA is contained in each serial-parallel converter 31 to 3n. At the end of a transmission cycle ZY the electronic processing unit 1 outputs a central release signal EN. The chain of inserted pattern data blocks D1 to Dn thus has a sequence which corresponds to the sequence of the chain of shift registers 31 to 3n on the serial data bus DB. After one transmission cycle ZY the shift register 3m, for example, of the module Mm thus has the pattern data block which is provided for driving the group Gm of actuation elements assigned to the shift register 3m.

Additionally, the control apparatus S has assignment means which, by way of example, are designated with the reference numbers 41 to 4n and 61 to 6n. Each of the assignment means are assigned to a group G1 to Gn of actuation elements. On receipt of a central release signal EN from the processing unit 1, the assignment means 41 to 4n and 61 to 6n synchronously cause the serial-parallel converters 31 to 3n to output the pattern data block they currently contain to an actuation element of the connected group G1 to Gn. Thus, a single actuation element for each group G1 to Gn is driven on receipt of a central release signal EN.

Figure 3B:
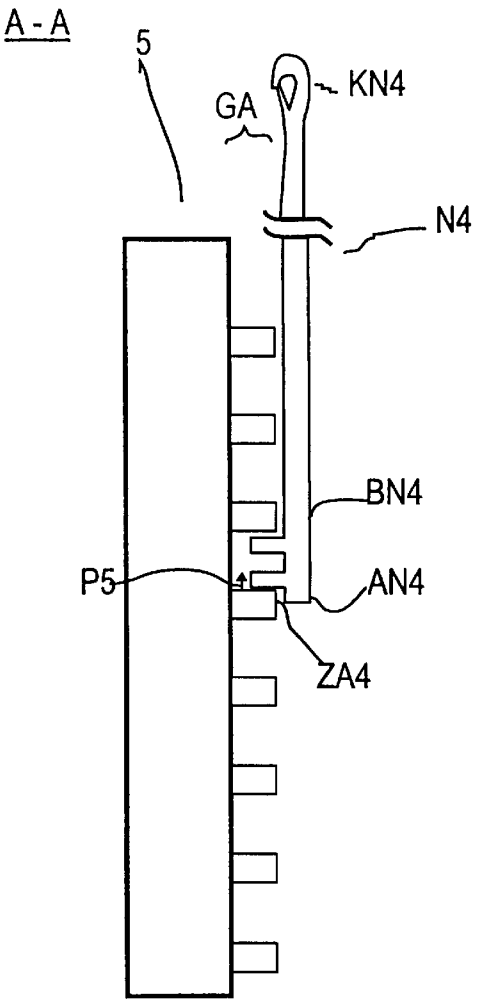
FIG. 3*b* shows a lateral view of a group of actuation elements of the actuation module shown in FIG. 3*a*, with a needle which passes thereby.
Figure 3A:
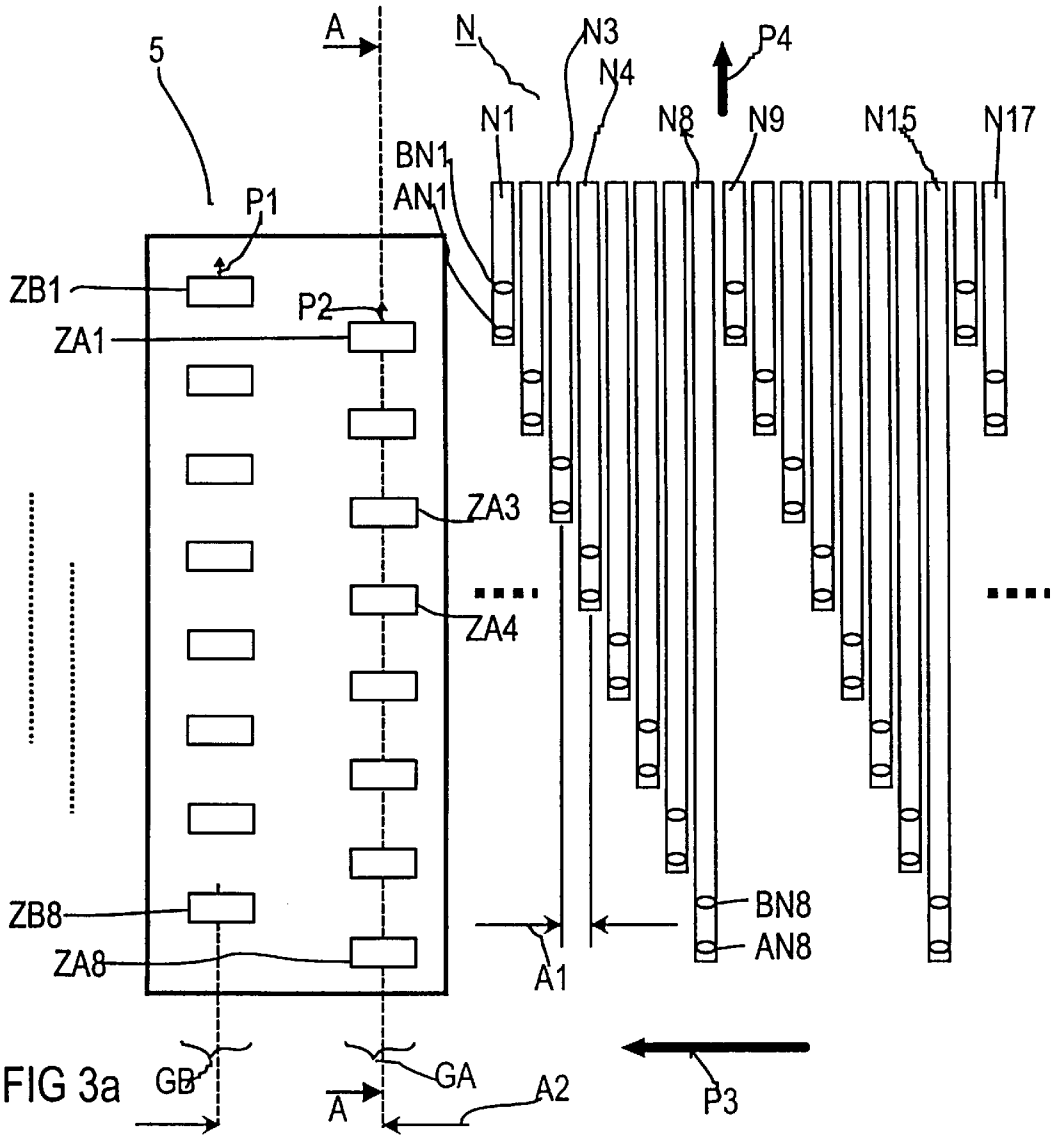
FIG. 3*a* shows a frontal view of an actuation module in which two groups of actuation elements are disposed and which serve to actuate needles which pass thereby.

FIGS. 3*a* and 3*b* show a frontal, or lateral, view of an actuation module 5 with, for example, two groups GA and GB of electrically drivable mechanical actuation elements ZA1 to ZA8 and ZB1 to ZB8, respectively. The groups G1 to Gn of mechanical actuation elements represented in the previous figures are explained further in connection with the groups GA and GB shown in FIGS. 3*a* and 3*b*. In general, the actuation elements of a group GA and GB are disposed sequentially. The actuation elements ZA1 to ZB8 are designated as actuators or selectors. The groups GA and GB, as shown here, are parallel to one another. Further, the actuation elements ZA1 and ZA8 and ZB1 to ZB8 are disposed vertically offset with respect to one another. The actuation elements ZA1 to ZA8 and ZB1 to ZB8 can be controlled by the electronic processing unit 1, and serve to mechanically actuate the thread guidance means N, wherein the thread guidance means N are for example, needles of a knitting machine, or are harness threads in a weaving loom. However, the actuation elements ZA1 to ZA8 and ZB1 to ZB8 can, for example, also be used in a warp control of a meshing machine. By the actuation of the needles N in a circular knitting machine, for example, the offset of the circular knitting machine and thus the processing of a thread assigned to the needle N are effected for the textile just produced. The needles N of a textile machine T, are generally present in great numbers in the needle cylinder NZ of a circular knitting machine as shown in FIGS. 1 and 2. Therefore, merely a portion of the needles, with respect to their total number, is represented in FIG. 3 with the reference numbers N1 to N17. Further, only the lower area of each needle is represented in FIG. 3*a* for the sake of comprehensibility.

Preferably, so-called piezoelectric or electromagnetic placeable drives, such as piezoelectric flexible converters, serve as actuation elements ZA1 to ZA8 and ZB1 to ZB8. The piezoelectric flexible converters are generally disposed in so-called flexible converter modules 5 where each of the piezoelectric flexible converter modules can have one or more groups G1 to Gn with sequentially disposed flexible converters. For example, in the case of a textile machine T, flexible converter modules each with a group of sequentially disposed flexible converters can be used in so-called one-way knitting systems. And flexible converter modules with two groups of sequentially disposed flexible converters can be used in so-called two-way knitting systems.

Below, the mode of action of the actuation elements ZA1 to ZA8 and ZB1 to ZB8 is explained further in the example of a circular knitting machine such as textile machine T, with needles N as thread guidance means.

The lower areas of the needles N represented in FIGS. 3*a* and 3*b* are also designated as so-called pattern circuit boards which have so-called pattern circuit board cams AN1 to AN8 and BN1 to BN8 for mechanical actuation by the actuation elements ZA1 to ZA8 and ZB1 to ZB8. Therein, the needles N run on the actuation elements in the direction of the arrow P3. The pattern circuit board cams AN1 to AN8 and BN1 to BN8 serve as a type of coding of the needles and are disposed thereon in such a way that a needle N1 to N17 can only be actuated by a certain actuation element ZA1 to ZA8 and ZB1 to ZB8 for each group GA or GB.

The actuation elements ZA1 to ZA8 and ZB1 to ZB8, are driven by the electronic processing unit 1 of the control apparatus S. In the actuation module 5, shown in FIG. 3*a*, only one actuation element ZA1 to ZA8 of the group GA and one actuation element ZB1 to ZB8 of the group GB is driven in one transmission cycle ZY. In a preferred form of the invention, the assignment means 41 to 4n and 61 to 6n, see FIG. 2, cause the shift registers 31 to 3n to output the selected part of the buffered data sequence D1 to Dn in a sequence corresponding to the sequential arrangement of the respective actuation elements ZA1 to ZA8 or ZB1 to ZB8.

The various arrangements of the pattern circuit board cams AN1 to AN8 or BN1 to BN8 on the needles N1 to N17 are also designated as tracks for the needles. The number of the tracks of the needles N generally corresponds to the number of the actuation elements ZA1 to ZA8 or ZB1 to ZB8 for each group GA or GB. In the example of FIGS. 3*a* and 3*b*, the needles N1 to N17 have eight tracks. Thus, there are eight different codings present which are effected by the corresponding arrangement of the pattern circuit board cams AN1 to AN8 or BN1 to BN8 on the needles N1 to N8. The sequence of the needles N1 to N8 continues to repeat itself in the example of FIG. 3*a*. Thus, the arrangement of needles N9 to N15 is the same as that of needles N1 to N8. Further, the arrangement is repeated in the following, no longer completely represented, needles.

In the case of a two-way knitting system, as represented in FIG. 3*a* for example, the needles N1 to N8 can be actuated via their first pattern circuit board cams AN1 to AN8 coming into contact with the actuation elements ZA1 to ZA8 of the first group GA, and via their second pattern circuit board cams BN1 to BN8 coming into contact with the actuation elements ZB1 to ZB8 of the second group GB. The first and second groups GA and GB are also designated as half modules. In FIG. 3*a*, the needle N1 can be actuated initially via the actuation element ZA1 of the first group GA and, in addition, actuated via the actuation element ZB1 of the second group GB. Thereby, for example, actuation of a lower pattern circuit board cam AN1 effects a so-called full stroke path, and retroactive actuation of an upper pattern circuit board cam BN1 effects a so-called half stroke path of the needle N1.

The activation of an actuation element ZA1 to ZA8, ZB1 to ZB8 of the actuation module 5 causes a lateral shift of the corresponding actuation element. For example, as shown in FIG. 3*a*, the lateral shift of actuation elements ZB1 and ZB2 is shown by the arrows P1 and P2. The needles N generally lie close to one another, and pass over the fixed actuation module 5, in this case in the direction of the arrow P3. In the case of a circular knitting machine, the needles N are generally disposed in the form of a ring in a needle cylinder NZ. The spacing Al between two needles, for example the rotating needles N3 and N4, is generally significantly smaller than the spacing A2 between the two groups of actuation elements GA and GB.

For example, the activation of the actuation element ZA1 causes it to laterally shift as indicated by P2. Then, upon rotation of the needle cylinder NZ in the direction indicated by P3, the pattern circuit board cam AN1 of the needle N1 runs up on the actuation element ZA1 thereby causing the needle N1 to move in a full stroke path position, as is represented for example by way of the arrow P4. Similarly, activation of the actuation element ZB1 causes it to laterally shift as indicated by the arrow P1 so that the pattern circuit board cam BN1 of the needle N1 then also runs up on the actuation element ZB1, and the needle N1 shifts in the direction of the arrow P4 into half stroke path position.

FIG. 3*b* shows a lateral view of the first group GA of actuation elements ZA1 to ZA8 of the actuation module 5 from FIG. 3*a*. The lateral view of FIG. 3*b* shows a needle N4 in cooperation with the first group GA of the actuation elements ZA. The upper area of the needle N4 includes a needle head KN4 which, on actuation of the needle N4, acts on a thread for the formation of textile surfaces. The needle N4 has mounted thereon the two pattern circuit board cams AN4 and BN4 which are disposed in such a way that actuation of the needle N4 by the first group GA can only be done by the actuation element ZA4. The direction of activation of the actuation element ZA4 is, by way of example, represented by the arrow designated as P5. A deflection of the actuation element ZA4 causes the pattern circuit board cam AN4 to run-up on the actuation element ZA4 thereby activating the needle N4 that it is incorporated into the textile production process.

Figure 4:
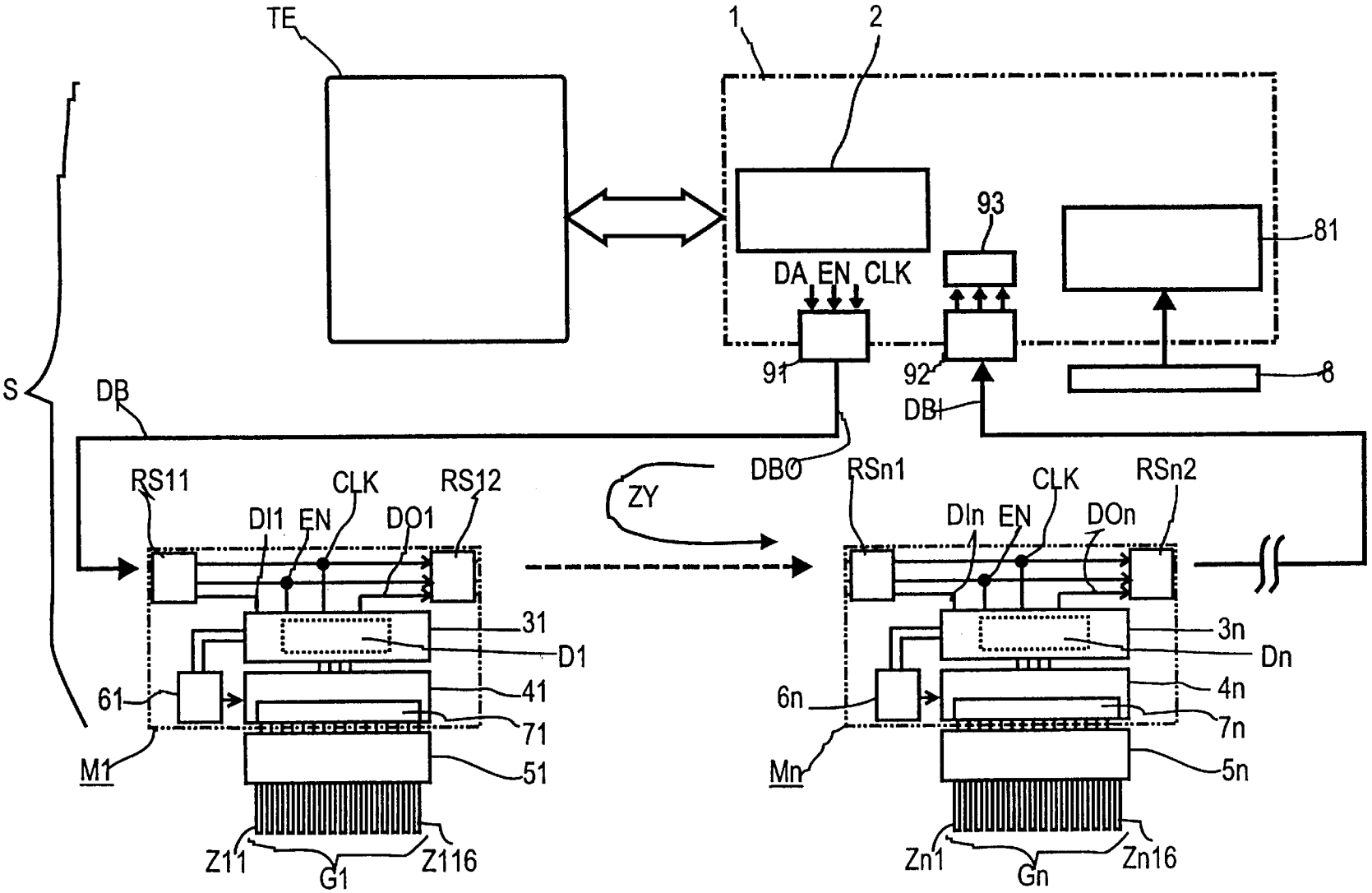
FIG. 4 shows a schematic design of a serial data bus which is connected to an electronic control apparatus and which is sequentially connected to shift registers of a textile machine.

In FIG. 4 an additional exemplary schematic design of the invention is represented. The control apparatus S according to the invention outputs the textile pattern data 2 to the groups G1 to Gn of actuation elements. The actuation elements of the groups G1 and Gn are denoted by the reference numbers Z11 to Z116 and Zn1 to Zn16.

For each transmission cycle ZY, the electronic processing unit 1 forms a pattern data chain DA which contains pattern data blocks D1 to Dn. A pattern data chain DA contains, in this case, those pattern data blocks D1 to Dn which are required in the corresponding transmission cycle ZY to drive each actuation element Z11 to Zn16 for each group G1 to Gn. Furthermore, the electronic processing unit 1 inserts the pattern data chain DA into the serial data bus DB so that, as represented in FIG. 4, at the end of the corresponding transmission cycle ZY at least one pattern data block D1 to Dn from the pattern data chain DA is contained in each shift register 31 to 3n. Thereby, advantageously, no addressing of the individual shift registers 31 to 3n, for example via an address bus, is required for data transmission. At the end of each transmission cycle ZY the electronic processing unit 1 outputs a central release signal EN which is received by the assignment means 41 to 4n and 61 to 6n. Upon receipt of the central release signal EN the assignment means 41 to 4n and 61 to 6n cause the shift registers 31 to 3n to synchronously output the pattern data blocks D1 to Dn they currently contain to an actuation element Z11 to Zn16 of the associated group G1 to Gn. The release signal EN serves specifically for the synchronization of the assignment means which are each assigned to a group G1 to Gn of actuation elements Z11 to Zn16.

In an advantageous embodiment of the electrical control apparatus S, the assignment means 41 to 4n and 61 to 6n cause the shift registers 31 to 3n to output their pattern data blocks D1 to Dn to a subsequent actuation element Z11 to Zn16 in the group G1 to Gn associated with each on receipt of a central release signal EN. In the case of a sequential arrangement of the actuation elements in a group, the assignment means 41 to 4n and 61 to 6n, upon receipt of a central release signal EN, cause the shift registers 31 to 3n to output the pattern data blocks D1 to Dn to the actuation elements Z11 to Zn16 by group G1 to Gn in such a sequence that the sequence corresponds to the sequential arrangement of the actuation elements in the associated group.

Preferably, an electronic evaluation circuit 81 of the processing unit 1 causes the synchronization of the shift registers 31 to 3n by using the central release signals EN, and the output of the clock generator 8. The clock generator 8 is, for example, an angular clock generator. The evaluation circuit 81 calculates, in particular, the positioning of the thread guidance means N with respect to the respective groups G1 to Gn and their actuation elements Z11 to Zn16. In the example of FIG. 4, each group G1 to Gn is disposed in an actuation module 51 to 5n with sixteen actuation elements Z11 to Z116 and Zn1 to Zn16 each.

According to the invention, the serial data bus DB sequentially connects the shift registers 31 to 3n. By way of the serial data bus DB, the processing unit 1 transmits one pattern data chain DA, formed from the textile pattern data 2, to the shift registers 31 to 3n per transmission cycle ZY. The serial data bus DB has, for this purpose, a data line which in the example of FIG. 4 is represented in the individual control modules M1 to Mn as incoming data lines DI1 to DIn and as outgoing data lines as DO1 and DOn. During the transmission of the pattern data block Dn of the pattern data chain DA to the module Mn, for example, the pattern data block DN thus first runs through the shift register 31 and the following shift register until, depending on the length of the pattern data chain DA, it reaches the shift register 3n.

Furthermore, the data bus DB has a signal line to the modules M1 to Mn for the transmission of the central release signals EN. Also, for serial data transmission, a timing circuit for clock signals CLK is preferably provided. The above arrangement serves for the serial data transmission of the pattern data blocks D1 to Dn and the timing of the shift registers 31 to 3n connected therewith. For signal amplification, the modules M1 to Mn have serial input and output interfaces RS11 or RS12 to RSn1 or RSn2. Preferably, the serial data bus DB is designed as a so-called differential signal data bus where at least the data lines, which generally have a high clock frequency, are doubled.

In one embodiment of the invention, the data bus DB is routed back to the processing unit 1 after having been routed to the control modules M1 to Mn. In addition to including a serial output interface 91, for transmitting data into the data bus DB, the processing unit 1 also includes a serial input interface 92 for inputting the pattern data chain DA with the pattern data blocks D1 to Dn back into the processing unit 1 after they have been inserted into the chain of shift registers 31 to 3n in one transmission cycle ZY. The serial input interface 92 inputs into the processing unit, in a following transmission cycle ZY, for example, the pattern data chain DA that was input into the data bus DB in a previous transmission cycle ZY. The invention therefore allows feedback in a further transmission of the pattern data chain DA of the previous data cycle ZY, and this feedback is done at the same time as the insertion of a newly formed pattern data chain DA with new pattern data blocks D1 to Dn. The data output and data input of the processing unit 1 is, in the example of FIG. 4, designated by the reference numbers DBO and DBI. The serial data bus DB routed back to the processing unit 1 is also designated as a serial ring data bus which, beginning at the processing unit 1 and connecting the shift registers 31 to 3n, is routed back to the processing unit 1.

The assignment means of the control apparatus preferably have, for each actuation element Z11 to Zn16, at least one storage element 71 to 7n which buffers a pattern data block D1 to Dn for an actuation element Z11 to Zn16. The storage elements 71 to 7n store the pattern data block D1 to Dn output to an actuation element Z11 to Zn16 until the same actuation element Z11 to Zn16 is overwritten anew in a later transmission cycle ZY. Thereby an activation of an actuation element continues to be maintained until the corresponding actuation element is driven anew in a later transmission cycle ZY. Advantageously, a sufficiently long-term mechanical actuation of the thread guidance means N is thus effected by the actuation elements that shift pattern circuit board cams of needles N and, thus, reliably activate the thread guidance means N.

In the exemplary embodiment of the invention represented in FIG. 4, the assignment means include multiplexers 41 to 4n which are each connected to a group G1 to Gn of actuation elements. The multiplexers 41 to 4n are also connected to the shift registers 31 to 3n and serve to assign a pattern data block D1 to Dn, currently contained in the shift register 31 to 3n, to an actuation element Z11 to Zn16 of the associated group G1 to Gn. Upon receipt of the central release signal EN the multiplexers 41 to 4n cause the shift registers 31 to 3n to synchronously output the pattern data block D1 to Dn currently contained in each to an actuation element Z11 to Zn16 of the associated group G1 to Gn. Preferably a counter 61 to 6n, whose mode of action is described in more detail in the following FIG. 5*a*, is connected to each of the multiplexers 41 to 4n.

Figure 5A:
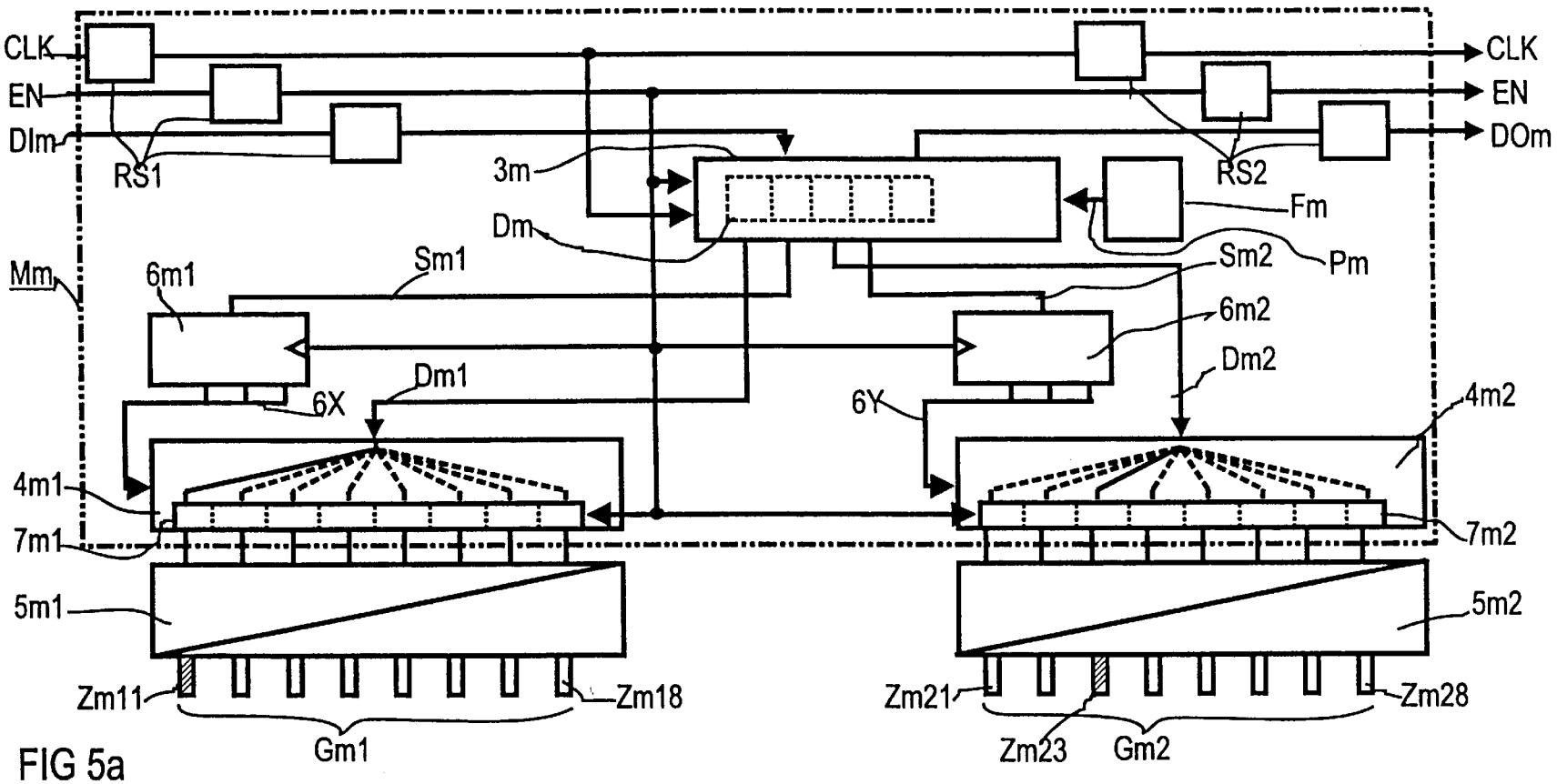
FIG. 5*a* shows a schematic design of a control module, according to one embodiment of the invention, that includes shift registers, counters, and multiplexers, for driving the actuation elements.

FIG. 5*a* shows the design of a module Mm, of the modules M1 to Mn, according to an additional preferred embodiment of the invention. This module Mm includes a shift register 3m, counters 6m1 and 6m2, and multiplexers 4m1 and 4m2 for driving the actuation elements ZM11 to ZM18 and ZM21 to Zm28. These modules M1 to Mn serve as control modules for the actuation modules 51 to 5n. The module Mm drives the actuation modules 5m1 and 5m2. Two groups Gm1 and Gm2 of actuation elements are connected to the shift register 3m in this exemplary embodiment. Each of the groups Gm1 and Gm2 has, for example, eight sequentially disposed and electrically driven mechanical actuation elements ZM11 to ZM18 or ZM21 to Zm28. In particular, each of the groups Gm1 and Gm2 here are disposed in a so-called actuation half module 5m1 or 5m2. The two actuation half modules 5m1 and 5m2 can further be combined into one actuation module as, for example, a piezoelectric flexible converter module. Preferably, in this case, a control module is assigned to each actuation module. The invention and its embodiments are described further in the example of the module Mm below whose design and mode of function can be transferred by analogy to the modules M1 to Mn.

The serial data bus DB manages a data line with data input DIm and data outputs DOm lines via which the control apparatus 1 inserts the pattern data blocks Dm1 and Dm2 into the shift register 3m, for buffering, in one transmission cycle ZY. A pattern data block Dm1 and Dm2 is thus provided to each actuation element ZM11 or Zm23, for example, of the groups Gm1 or Gm2. As represented in the previously described figures, the shift register 3m in this case is incorporated in a chain of the shift registers 31 to 3n via the serial data bus DB. Furthermore, the data bus DB has a line for a clock signal CLK for serial data transmission and, in particular, for timing the shift registers 31 to 3n including the shift register 3m. The shift registers 31 to 3n are built, for example, of so-called flip-flop circuits. The serial data bus DB also transmits the central release signal EN.

Figure 5B:
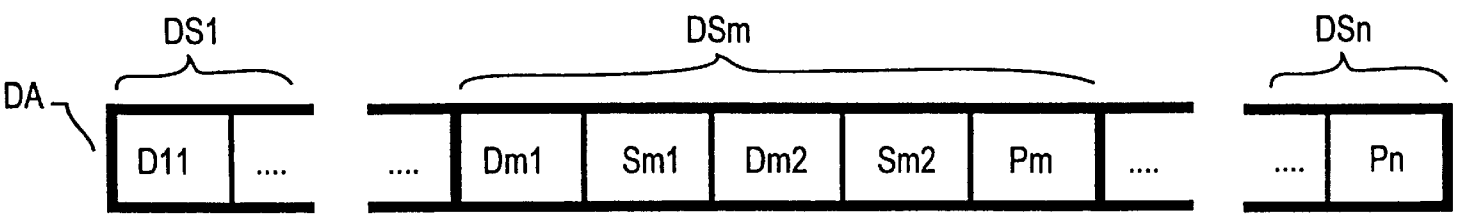
FIG. 5*b* shows a pattern data chain inserted into the chain of shift registers during one data cycle, wherein the pattern data chain includes pattern data blocks, control data blocks, and test data blocks.

FIG. 5*b* shows a pattern data chain DA, which is inserted within one transmission cycle ZY into the chain of the shift registers 31 to 3n, which includes pattern data sequences DS1 to DSn. At the end of one transmission cycle ZY, each shift register 31 to 3n contains a pattern data sequence DS1 or DSn so that the shift register 3m contains the pattern data sequence DSm. The pattern data sequences DSm contain, in this case, the pattern data blocks Dm1 and Dm2 for driving each of the actuation elements ZM11 or Zm23 in each group Gm1 or Gm2. The number of pattern data blocks for each pattern data sequence DSm corresponds to the number of groups of actuation elements connected to the shift register 3m. The data sequence DSm represented in FIG. 5*b*, for example, is inserted during one transmission cycle ZY by the control apparatus 1 into the shift register 3m of the module Mm for buffering. In the example of FIGS. 5*a* and 5*b*, the pattern data blocks Dm1 Dm2 of the data sequence Dm are present in the form of data bits for the binary driving of certain actuation elements by group. For example, a logical "1" of the data bit causes an activation and a logical "0" a deactivation of the corresponding actuation element ZM11 or Zm23.

In a further embodiment of the invention, in which the assignment means include multiplexers 4m1 and 4m2, a counter 6m1 or 6m2 is connected to each multiplexer. Each counter 6m1 or 6m2 is timed by the central release signal EN. The counters 6m1 and 6m2 each have counter values 6X and 6Y where one counter value 6X or 6Y of the corresponding counter 6m1 or 6m2 is assigned to each actuation element ZM11 to Zm28 or ZM21 to Zm28 of a group Gm1 or Gm2. The counters 6m1 or 6m2 control the assigned multiplexer 4m1 or 4m2 in such a way that it causes the shift register 3m to output the pattern data block Dm1 or Dm2 currently contained therein to an actuation element ZM11 to Zm23 of the associated group Gm1 or Gm2 to which the current counter value 6X or 6Y, of the counter 6m1 or 6m2, corresponds. In the exemplary embodiment of FIG. 5*a*, each counter 6m1 or 6m2 has eight counter values 6X or 6Y because each group Gm1 or Gm2 includes eight actuation elements ZM11 to ZM18 or ZM21 to Zm28. In the example of FIG. 5*a*, a current counter value 6X or 6Y of the counter 6m1 or 6m2 is present which leads to the output of the pattern data block Dm1 or Dm2 to the actuation element ZM11 or Zm23.

Preferably, the values of the counters 6m1 and 6m2 also take into account the central release signal EN, for example by a binary counter value that is increased or decreased.

If the highest or lowest counter value is reached, to which an actuation element ZM11 to ZM18 or ZM21 or Zm28 is assigned, then the counter 6m1 or 6m2 is set back, preferably automatically, to a lowest or highest counter value. Advantageously, the actuation elements ZM11 to ZM18 or ZM21 or Zm28 of a group Gm1 or Gm2 are driven by way of the counter 6m1 or 6m2 in a sequence which corresponds to the physical arrangement of the actuation elements in the corresponding group.

In a further advantageous embodiment of the invention, each pattern data chain DA represented in FIG. 5*b* includes control data blocks Sm1 and Sm2 for the assignment means 4m1, 4m2, 6m1, and 6m2. In this case, in addition to the pattern data blocks, at least one control data block Sm1 or Sm2 can be accepted by the shift register 3m for each assigned group Gm1 and Gm2. In the example of FIGS. 5*a* and 5*b*, each pattern data sequence DS1 to DSn thus contains at least one control data block corresponding to the number of assignment means connected to the shift registers 31 to 3n. The electronic processing unit 1 inserts the pattern data block DA into the serial data bus DB in transmission cycles ZY so that at the end of one transmission cycle ZY at least one pattern data block Dm1 or Dm2 and one control data block Sm1 or Sm2 from the pattern data chain DA is contained in the shift register 3m, as is naturally also the case in the other shift registers 31 to 3n. Upon receipt of the central release signal EN, the assignment means 4m1, 4m2, 6m1, and 6m2 cause the shift register 3m to synchronously output the pattern data blocks Dm1 or Dm2 currently contained therein to an actuation element ZM11 or Zm23 of the associated group Gm1 or Gm2.

Preferably, the control data blocks Sm1 and Sm2 merely reset the corresponding assignment means 4m1 and 4m2 or 6m1 and 6m2. For example, the control data blocks Sm1 or Sm2 reset the counter 6m1 or 6m2. Further, for example, a logical "1" as control bit of a control datum causes the corresponding counter to reset. Thus, transmission errors can be corrected by cyclically resetting the counters 6m1 or 6m2 which are initialized by the control data blocks Sm1 and Sm2. At the start up of a textile machine T, the electrical control apparatus S according to the invention must, generally, first be initialized. In so doing, the counters for the assignment means must be coordinated with the positions of the thread guidance means N, the positions of the groups, or the positions of the actuation elements. This can, for example, be done by the central control unit 1 and the clock generator 8 as described in connection with the previous figures.

Furthermore, the assignment means include a storage element 7m1 or 7m2 which buffers a pattern data block Dm1 or Dm2 of the buffered sequence DSm which is output to an actuation element ZM11 to ZM18 or ZM21 to Zm28.

In an additional advantageous embodiment of the invention as represented in FIG. 5*b*, the serial data bus DB is routed back to the electronic processing unit after having been routed to the control modules. Further, the control apparatus S includes at least one error detection apparatus Fm connected to at least one shift register. The error detection apparatus checks the operational status of the actuation elements. Preferably, in this case, an error detection apparatus Fm is contained in each module Mm which is assigned to the shift register 3m, wherein the error detection apparatus Fm serves to check the actuation elements ZM11 to ZM28 assigned to the respective module Mm. Further, each pattern data chain DA has at least one test data block Pm where preferably one test data block Pm is contained in each pattern data sequence DS1 to DSn. In this case, at least one test data block Pm, in addition to the pattern data blocks and control data blocks, can be accepted by the shift register 3m. The electronic processing unit 1 inserts the pattern data chains DA into the serial data bus DB in transmission cycles ZY so that at the end of a transmission cycle ZY least one pattern data block Dm1 and Dm2 and one test data block Pm from the pattern data chain DA is contained in each shift register 3m. In addition, as in the example of FIGS. 5*a* and 5*b* explained above, each shift register 3m also contains control data blocks Sm1 and Sm2. At least one error detection apparatus updates the test data block in the shift registers. At the end of one transmission cycle ZY the error detection apparatus Fm thus updates the test data block Pm contained in the shift register 3m.

In the test data block Pm, data are written by the error detection apparatus Fm for error diagnosis. The data in the test data block Pm relate to error-prone components and, in particular, to the mechanical actuation elements ZM11 to ZM28. For example, the test data block Pm can have a test bit set initially to logical "0" which is then set to logical "1" by the error detection apparatus Fm when it detects an error. The pattern data chain DA transmitted back into the processing apparatus 1 in the next transmission cycle is then analyzed by evaluation apparatus 93, in the processing apparatus, with regard to the test data blocks contained therein and updated by the error detection apparatuses. See FIG. 4, for example. Thus, an automated error diagnosis of the textile machine T takes place advantageously from a central point.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. Electrical control apparatus, for the output of textile pattern data to a plurality of groups of mechanical actuation elements for actuating thread guidance means of a textile machine, comprising:

a plurality of serial-parallel converters each of which is connected to at least one of said groups of mechanical actuation elements, wherein each of said serial-parallel converters is configured to accept, for each connected group of mechanical actuation elements, at least one pattern data block from the textile pattern data;

a serial data bus to which the serial-parallel converters are sequentially connected;

an electronic processing unit, having a first connection to said data bus, and which in transmission cycles forms, from the textile pattern data, pattern data chains containing pattern data blocks in such a way that one pattern data chain per transmission cycle contains pattern data blocks for driving one mechanical actuation element in each of said groups, and in said transmission cycles, said electronic processing unit inserts the pattern data chains into the serial data bus so that at the end of each transmission cycle at least one pattern data block from the pattern data chain is contained in each serial-parallel converter, wherein at the end of each transmission cycle said electronic processing unit outputs a central release signal; and a plurality of assignment means, each of which is connected to one of said groups of mechanical actuation elements, each of which is connected to a serial-parallel converter, and each of which is configured to receive a central release signal from said electronic processing unit, wherein upon receipt of a central release signal said plurality of assignment means causes the serial-parallel converters synchronously to output the pattern data block currently contained in each serial-parallel converter to an actuation element of the at least one group of mechanical actuation elements connected to that serial-parallel converter.

2. The control apparatus according to claim 1, wherein upon receipt of the central release signal, the plurality of assignment means synchronously cause each of the serial-parallel converters to output the pattern data block to a subsequent mechanical actuation element of the at least one group of mechanical actuation elements connected to that serial-parallel converter.

3. The control apparatus according to claim 1, wherein the mechanical actuation elements in each group are sequentially arranged, and each of the assignment means, on receipt of a central release signal, causes the connected serial-parallel converter to output pattern data blocks to the mechanical actuation elements in a sequence corresponding to the sequence of the arrangement of the mechanical actuation elements in the at least one group of mechanical actuation elements connected to that serial-parallel converter.

4. The control apparatus according to claim 1, wherein each of the plurality of the assignment means includes at least one multiplexer which is connected to a group of mechanical actuation elements, and on receipt of the central release signal, said plurality of multiplexers causes said plurality of serial-parallel converters synchronously to output the pattern data blocks currently contained in the serial-parallel converters to actuation elements of the groups of mechanical actuation elements connected to the serial-parallel converters.

5. The control apparatus according to claim 4, wherein a counter is connected to each of the multiplexers, and wherein each of said counters:

is timed by the central release signal;

has a plurality of counter values wherein one counter value is assigned to each mechanical actuation element in the group of mechanical actuation elements that is connected to the multiplexer connected to that counter; and drives the assigned multiplexer connected to that counter in such a way that said connected multiplexer causes the serial-parallel converter to output the pattern data block currently contained in that serial-parallel converter to an actuation element in the at least one group of mechanical actuation elements connected to that serial-parallel converter, which is assigned to the current counter value of the counter.

6. The control apparatus according to claim 1, wherein said electronic processing unit forms the pattern data chains so that each pattern data chain includes control data blocks for controlling the plurality of assignment means, further wherein at least one control data block is received by each serial-parallel converter, further wherein the electronic processing unit inserts the pattern data chains into the serial data bus in transmission cycles so that at the end of one transmission cycle at least one pattern data block and one control data block are contained in each serial-parallel converter, and wherein when said plurality of assignment means receive the central release signal, the plurality of assignment means causes said plurality of serial-parallel converters synchronously to output the control data block currently contained therein to a mechanical actuation element determined by the control data block.

7. The control apparatus according to claim 1, wherein each of the plurality of the assignment means includes at least one storage element for each of the mechanical actuation elements in the group of mechanical actuation elements connected to that assignment means, wherein each storage element buffers a pattern data block for an associated mechanical actuation element.

8. The control apparatus according to claim 1, wherein the data bus is routed back to make a second connection with the electronic processing unit, and wherein said control apparatus is configured so that a pattern data chain inserted through said first connection into the serial data bus in one transmission cycle is inserted back into the processing unit through said second connection in the following transmission cycle.

9. The control apparatus according to claim 8, further including at least one error detection apparatus connected to each of the plurality of serial-parallel converters, wherein each error detection apparatus checks the operational status of the actuation elements wherein:

the electronic processing unit forms the pattern data chains so that each includes test blocks and at least one test data block is received by each of the serial-parallel converters;

the electronic processing unit inserts the pattern data chains into the serial data bus in transmission cycles so that at the end of one transmission cycle at least one pattern data block and one test data block from the pattern data chain is contained in each serial-parallel converter; and the error detection apparatus updates the test data blocks contained in the serial-parallel converters.

10. The control apparatus according to claim 1, wherein said plurality of serial-parallel converters includes shift registers.

11. An electrical control apparatus, for the output of textile pattern data to a plurality of groups of mechanical actuation elements for actuating thread guidance mechanisms of a textile machine, comprising:

a plurality of serial-parallel converters each of which is connected to at least one of said groups of mechanical actuation elements, wherein each of said serial-parallel converters is configured to accept, for each connected group of mechanical actuation elements, at least one pattern data block from the textile pattern data;

a serial data bus to which the serial-parallel converters are sequentially connected;

an electronic processing unit, having a first connection to said data bus, and which in transmission cycles forms, from the textile pattern data, pattern data chains containing pattern data blocks in such a way that one pattern data chain per transmission cycle contains pattern data blocks for driving one mechanical actuation element in each of said groups, and in said transmission cycles, said electronic processing unit inserts the pattern data chains into the serial data bus so that at the end of each transmission cycle at least one pattern data block from the pattern data chain is contained in each serial-parallel converter, wherein at the end of each transmission cycle said electronic processing unit outputs a central release signal; and a plurality of assignment circuits, each of which is connected to one of said groups of mechanical actuation elements, each of which is connected to a serial-parallel converter, and each of which is configured to receive a central release signal from said electronic processing unit, wherein upon receipt of a central release signal said plurality of assignment circuits synchronously causes the serial-parallel converters to output the pattern data block currently contained in each serial-parallel converter to an actuation element of the at least one group of mechanical actuation elements connected to that serial-parallel converter.

* * * * *